US009310035B2

(12) United States Patent
Trott et al.

(10) Patent No.: US 9,310,035 B2
(45) Date of Patent: Apr. 12, 2016

(54) LIGHT FIXTURES AND LIGHTING DEVICES

(75) Inventors: Gary David Trott, Morrisville, NC (US); Paul Kenneth Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 242 days.

(21) Appl. No.: 12/116,341

(22) Filed: May 7, 2008

(65) Prior Publication Data

US 2008/0278952 A1 Nov. 13, 2008

Related U.S. Application Data

(60) Provisional application No. 60/916,407, filed on May 7, 2007, provisional application No. 61/029,068, filed on Feb. 15, 2008, provisional application No. 61/037,366, filed on Mar. 18, 2008.

(51) Int. Cl.

| | |
|---|---|
| ***F21V 29/00*** | (2015.01) |
| ***F21S 8/02*** | (2006.01) |
| ***F21V 11/02*** | (2006.01) |
| ***F21V 29/70*** | (2015.01) |
| *F21Y 101/02* | (2006.01) |

(52) U.S. Cl.

CPC . *F21S 8/02* (2013.01); *F21V 11/02* (2013.01); *F21V 29/70* (2015.01); *F21V 29/004* (2013.01); *F21Y 2101/02* (2013.01)

(58) Field of Classification Search

CPC ..... F21S 8/02; F21V 29/70; F21V 29/004; F21Y 2101/02

USPC ..... 362/290, 249.01, 249.02, 291, 311.02, 362/325, 342, 264

See application file for complete search history.

(56) References Cited

U.S. PATENT DOCUMENTS

| | | | | |
|---|---|---|---|---|
| 1,675,731 | A | 7/1928 | Schofield | |
| 1,791,718 | A | 2/1931 | Dye et al. | |
| 2,142,395 | A * | 1/1939 | Herron | 362/291 |
| 3,169,710 | A * | 2/1965 | Lipscomb | 362/292 |
| 3,373,275 | A * | 3/1968 | High | 362/330 |
| 3,788,206 | A * | 1/1974 | Mulvey | 454/293 |
| D258,919 | S * | 4/1981 | Kristofek | D26/142 |

(Continued)

FOREIGN PATENT DOCUMENTS

| | | |
|---|---|---|
| DE | 295 01 661 U1 | 10/1995 |
| EP | 0 684 425 B1 | 11/1995 |
| GB | 183274 | 7/1922 |

OTHER PUBLICATIONS

Focal Point Web Material, "Focal Point® launches two dimensions of popular Sky™ family", date: 2002, p. 1.

(Continued)

*Primary Examiner* — Sharon Payne

(74) *Attorney, Agent, or Firm* — Burr & Brown, PLLC

(57) ABSTRACT

There is provided a light fixture comprising a baffle system and a side reflector, the baffle system comprising at least an outer baffle structure and an inner baffle structure. Also, there is provided a light fixture which comprises at least two recessed concentric square elements, triangular connecting elements and lenses which are recessed from the faces of each of the square elements. In some embodiments, the lighting device comprises at least one solid state light emitter. In some embodiments, the light fixture further comprises at least one lens positioned between at least two respective baffle elements.

53 Claims, 6 Drawing Sheets

(56) References Cited

U.S. PATENT DOCUMENTS

| | | | | |
|---|---|---|---|---|
| 5,149,191 | A * | 9/1992 | Lewin et al. | 362/290 |
| 5,465,199 | A * | 11/1995 | Bray et al. | 362/364 |
| 5,890,794 | A | 4/1999 | Abtahi et al. | |
| D428,516 | S | 7/2000 | Reo et al. | |
| D430,339 | S | 8/2000 | Reo | |
| D437,446 | S | 2/2001 | Reo et al. | |
| 6,238,065 | B1 | 5/2001 | Jones | |
| D443,949 | S | 6/2001 | DiMonte | |
| 6,527,422 | B1 * | 3/2003 | Hutchison | 362/373 |
| 7,213,940 | B1 | 5/2007 | Van De Ven et al. | |
| 7,290,906 | B2 | 11/2007 | Suzuki et al. | |
| D558,382 | S * | 12/2007 | Cesaro | D26/86 |
| 2001/0050852 | A1 | 12/2001 | Jones | |
| 2002/0080602 | A1 | 6/2002 | Jones | |
| 2003/0053314 | A1 | 3/2003 | Summerford et al. | |
| 2004/0165388 | A1 * | 8/2004 | Shoji | 362/304 |
| 2007/0030692 | A1 * | 2/2007 | Waring | 362/582 |

OTHER PUBLICATIONS

Focal Point Web Material, "Sky™ 2x2", date: 2002, p. 1.
Focal Point literature, "Sky™ 2x2", pp. 116-117.
Focal Point literature, "Sky™ 4x4", pp. 118-119.
U.S. Appl. No. 11/614,180, filed Dec. 21, 2006.
U.S. Appl. No. 11/613,714, filed Dec. 20, 2006.
U.S. Appl. No. 11/624,811, filed Jan. 19, 2007.
U.S. Appl. No. 11/751,982, filed May 22, 2007.
U.S. Appl. No. 11/753,103, filed May 24, 2007.
U.S. Appl. No. 11/751,990, filed May 22, 2007.
U.S. Appl. No. 11/736,761, filed Apr. 18, 2007.
U.S. Appl. No. 11/736,799, filed Apr. 18, 2007.
U.S. Appl. No. 11/936,163, filed Nov. 7, 2007.
U.S. Appl. No. 12/117,122, filed May 8, 2008.
U.S. Appl. No. 12/117,131, filed May 8, 2008.
U.S. Appl. No. 11/843,243, filed Aug. 22, 2007.
U.S. Appl. No. 11/948,021, filed Nov. 30, 2007.
U.S. Appl. No. 11/870,679, filed Oct. 11, 2007.
U.S. Appl. No. 11/951,626, filed Dec. 6, 2007.
U.S. Appl. No. 12/117,148, filed May 8, 2008.
U.S. Appl. No. 12/117,271, filed May 8, 2008.
U.S. Appl. No. 12/017,676, filed Jan. 22, 2008.
U.S. Appl. No. 12/116,346, filed May 7, 2008.
U.S. Appl. No. 12/116,348, filed May 7, 2008.
U.S. Appl. No. 12/056,851, filed Mar. 27, 2008.
U.S. Appl. No. 60/990,435, filed Nov. 27, 2007.
U.S. Appl. No. 13/365,618, filed Feb. 3, 2012, Pickard et al.
Taiwan Office Action (and translation provided by foreign counsel) from a corresponding Taiwan patent application bearing a mailing date of Jan. 23, 2013, 24 pages.

* cited by examiner

LIGHT FIXTURES AND LIGHTING DEVICES

CROSS-REFERENCE TO RELATED APPLICATIONS

This application claims the benefit of U.S. Provisional Patent Application No. 60/916,407, filed May 7, 2007, the entirety of which is incorporated herein by reference.

This application claims the benefit of U.S. Provisional Patent Application No. 61/029,068, filed Feb. 15, 2008, the entirety of which is incorporated herein by reference.

This application claims the benefit of U.S. Provisional Patent Application No. 61/037,366, filed Mar. 18, 2008, the entirety of which is incorporated herein by reference.

FIELD OF THE INVENTIVE SUBJECT MATTER

The present inventive subject matter relates to a light fixture. In some aspects, the present inventive subject matter relates to a light fixture for use with solid state light emitters, e.g., light emitting diodes (LEDs).

BACKGROUND

A large proportion (some estimates are as high as twenty-five percent) of the electricity generated in the United States each year goes to lighting. Accordingly, there is an ongoing need to provide light fixtures (1) which are easier to install, (2) which reduce the possibility of injury during installation, repair, maintenance, replacement and/or removal, and/or (3) which make it possible for the light fixture to be held more securely in place.

In addition, with the growing popularity of lighting devices which include solid state light emitters (e.g., light emitting diodes), there is an increasing demand for light fixtures (and components thereof) which facilitate the use of such lighting devices while maximizing the benefits obtained from using such lighting devices and minimizing or eliminating any drawbacks from using such lighting devices.

One particular type of light fixture is known as a lay-in luminaire, or a troffer. The lensed troffer is the most popular lay-in sold today. It is a commodity that is sold for use in applications where price is the primary buying consideration. For many decades, the recessed parabolic was the standard for high performance applications such as offices. The "parabolic" style troffer utilizes aluminum baffles to shield the light and maximize high angle shielding while sacrificing light on the walls. In recent years, the market has been moving away from the parabolics towards with broader distributions for high performance applications.

Efforts have been ongoing to develop ways by which solid state light emitters can be used in place of incandescent lights, fluorescent lights and other light-generating devices in a wide variety of applications. In addition, where light emitting diodes (or other solid state light emitters) are already being used, efforts are ongoing to provide light emitting diodes (or other solid state light emitters) which are improved, e.g., with respect to energy efficiency, color rendering index (CRI Ra), contrast, efficacy (lm/W), cost and/or duration of service.

BRIEF SUMMARY OF THE INVENTIVE SUBJECT MATTER

As indicated above, some aspects of the present inventive subject matter are directed to providing light fixtures which are suitable for use with light emitting elements which includes solid state light emitters.

Currently, there is strong preference for troffers with specific attributes. For example, when experiencing the troffer from a distance, the occupant should perceive it to be low in brightness. This is balanced with the need to deliver light high onto walls to maximize the sense of spaciousness within a environment. As the occupant moves closer to a fixture, the brightness of the fixture should increase slowly with no distracting rapid increases in luminance. Once seated, the occupant should be comfortable sitting beneath the light for long periods of time. When viewed from high angles, the light should be low in brightness to minimize high angle glare and the potential for reflected glare on the computer screen.

It would be difficult to achieve these challenging design criteria with solid state light emitters. It was also recognized that it would be a challenge to manage the extreme luminance of a solid state light emitter source in producing the 4000+ lumens which a troffer generally requires. It would be desirable to be able to satisfy these needs.

In accordance with the present inventive subject matter, there are provided light fixtures which satisfy these needs, and which further enable new aesthetic possibilities. In addition, in accordance with the present inventive subject matter, there are provided light fixtures (e.g., troffers) for solid state light emitters which satisfy these needs, and which further enable new aesthetic possibilities.

According to the present inventive subject matter, there are provided devices which include specific mechanical shielding of refractive and reflective optical materials as disclosed herein, with carefully balanced radiative coupling and luminances.

In accordance with a first aspect of the present invention, there is provided a light fixture comprising a baffle system and a side reflector, the baffle system comprising at least an outer baffle structure and an inner baffle structure, an extremity of the outer baffle structure being in a first plane, at least one surface of the side reflector abutting at least one surface of the outer baffle structure, the inner baffle structure being entirely within planes which extend through the outer periphery of the outer baffle structure perpendicular to the first plane, an extremity of the inner baffle structure being in a second plane, the second plane being spaced from the first plane.

In some embodiments according to the first aspect of the present invention:

the light fixture further comprises at least one lighting device, the first plane is at a location where, if the lighting device is illuminated, light travels through the first plane, and the second plane is at a location where, if the lighting device is illuminated, light travels through the second plane.

In some of such embodiments, the lighting device comprises at least one solid state light emitter, each of the at least one solid state light emitter being located entirely within a region defined by planes which extend through the extremity of the inner baffle structure perpendicular to the first plane. In some of these embodiments, if the lighting device is illuminated, light passes through the first plane before passing through the second plane.

In some of such embodiments, if the lighting device is illuminated, light passes through a third plane before passing through the first plane, the third plane being parallel to the first plane, the extremity of the outer baffle structure is a first series of points extending around a periphery of the outer baffle structure, wherein each of the first series of points is, for each radial position around the periphery of the outer baffle structure, a maximum distance from the third plane, and the extremity of the inner baffle structure is a second series of points extending around a periphery of the inner baffle structure, wherein each of the second series of points is, for each radial position around the periphery of the inner baffle structure, a maximum distance from the third plane. In some of these embodiments, the first series of points defines a first substantially square shape, and the second series of points defines a second substantially square shape.

In some embodiments according to the first aspect of the present invention, the baffle system comprises a plurality of baffle elements and the light fixture further comprises at least one lens, each of the at least one lens being positioned between at least two respective baffle elements. In some of such embodiments, the light fixture comprises at least a first lens abutting the outer baffle structure, the first lens being spaced from the first plane, the first lens being positioned on a side of the first plane which is opposite from the second plane, and the light fixture comprises at least a second lens abutting the inner baffle structure, the second lens being positioned on a side of the second plane which is the same as the first plane.

In some embodiments according to the first aspect of the present invention, the side reflector is slanted at an angle of from about 20 degrees to about 40 degrees relative to the first plane.

In some embodiments according to the first aspect of the present invention, the outer baffle structure comprises a plurality of outer baffle elements, each of the outer baffle elements having an outer baffle element first side and an outer baffle element second side which are substantially perpendicular to the first plane, and the inner baffle structure comprises a plurality of inner baffle elements, each of the inner baffle elements having an inner baffle element first side and an inner baffle element second side which are substantially perpendicular to the second plane.

In accordance with a second aspect of the present invention, there is provided a light fixture comprising:

a lighting device;

a baffle system, the baffle system comprising a plurality of baffle elements, at least one side reflector; and at least one lens, each of the at least one lens being positioned between respective baffle elements, first and second major dimensions of the light fixture extending in a first plane, at least one surface of the side reflector abutting at least one surface of the baffle system, wherein if a viewer moves from a first position to a second position, the first and second positions both being in a viewer plane which is parallel to the first plane and which is spaced from the first plane by three feet, the viewer plane being on a side of the first plane where, if the lighting device is illuminated, light travels from the lighting device toward the viewer plane, the second position being on a line which extends through a center of the light fixture perpendicular to the first plane, the first position being at least 30 feet from the second position, the viewer will see within an area bounded by the at least one side reflector:

initially only at least one of the at least one side reflector, then a portion of the baffle system which is closest to the viewer plane, then more of the baffle system, and then one or more of the lenses, and if the lighting device is illuminated in an absence of other light:

the side reflector will be illuminated by the baffle system with an average luminance which is less than an average luminance of the baffle elements, and a luminance gradient will be greatest next to the baffle elements and least at regions adjacent to and outside the at least one side reflector.

In some embodiments according to the second aspect of the present invention, when the viewer reaches the second position, the viewer will be able to see at least a portion of each baffle element in the light fixture and each lens in the light fixture, the baffle elements in the light fixture and the at least one lens in the light fixture together occupying an entire area surrounded by the side reflector.

In some embodiments according to the second aspect of the present invention, the baffle system comprises an inner baffle structure, and the lighting device comprises at least one solid state light emitter, each of the at least one solid state light emitter being located entirely within a region defined by planes which extend through an extremity of the inner baffle structure perpendicular to the first plane.

In some embodiments according to the second aspect of the present invention, the side reflector is slanted at an angle of from about 20 degrees to about 40 degrees relative to the first plane.

In accordance with a third aspect of the present invention, there is provided a light fixture comprising a baffle system and a side reflector, the baffle system comprising at least an outer baffle structure, an inner baffle structure and at least a first intermediate baffle structure, the outer baffle structure being annular, an extremity of the outer baffle structure being in a first plane, at least one surface of the side reflector abutting at least one surface of the outer baffle structure, the first intermediate baffle structure being annular, an extremity of the first intermediate baffle structure being in a second plane, the second plane being substantially parallel with the first plane, the inner baffle structure being annular, an extremity of the inner baffle structure being in a third plane, the third plane being substantially parallel with the second plane, the second plane being located between the first plane and the third plane, the outer baffle structure, the first intermediate baffle structure and the inner baffle structure each sharing at least two planes of symmetry, planes extending through portions of the outer baffle structure and being perpendicular to the first plane surrounding the first intermediate baffle structure, planes extending through portions of the first intermediate baffle structure and being perpendicular to the first plane surrounding the inner baffle structure.

In some embodiments according to the third aspect of the present invention, the light fixture further comprises at least one lighting device, the first plane is at a location where, if the lighting device is illuminated, light travels through the first plane, the second plane is at a location where, if the lighting device is illuminated, light travels through the second plane and the third plane being at a location where, if the lighting device is illuminated, light travels through the third plane.

In some of such embodiments, if the lighting device is illuminated, light travels through the first plane, then through the second plane, and then through the third plane;

In some of such embodiments, the lighting device comprises at least one solid state light emitter, each of the at least one solid state light emitter being located entirely within a region defined by planes which extend through the extremity of the inner baffle structure perpendicular to the first plane; and/or In some of such embodiments, if the lighting device is illuminated, light passes through a fourth plane before passing through the first plane, the fourth plane being parallel to the first plane, the extremity of the outer baffle structure is a first series of points extending around a periphery of the outer baffle structure, wherein each of the first series of points is, for each radial position around the periphery of the outer baffle structure, a maximum distance from the fourth plane, the extremity of the first intermediate baffle structure is a second series of points extending around a periphery of the first intermediate baffle structure, wherein each of the second series of points is, for each radial position around the periphery of the first intermediate baffle structure, a maximum distance from the fourth plane, and the extremity of the inner baffle structure is a third series of points extending around a periphery of the inner baffle structure, wherein each of the third series of points is, for each radial position around the periphery of the inner baffle structure, a maximum distance from the fourth plane.

In some of these embodiments, the first series of points defines a first substantially square shape, and the second series of points defines a second substantially square shape.

In some embodiments according to the third aspect of the present invention, the baffle system further comprises at least a first connector baffle structure extending from the outer baffle structure to the first intermediate baffle structure and a second connector baffle structure extending from the first intermediate baffle structure to the inner baffle structure.

In some embodiments according to the third aspect of the present invention, the outer baffle structure, the first intermediate baffle structure and the inner baffle structure are substantially concentric annular shapes. In some of such embodiments, each of the outer baffle structure, the first intermediate baffle structure and the inner baffle structure has a substantially square annular shape.

In some embodiments according to the third aspect of the present invention, the baffle system comprises a plurality of baffle elements, and the light fixture further comprises at least one lens, each of the at least one lens being positioned between at least two respective baffle elements. In some of such embodiments, the light fixture comprises at least a first lens abutting the outer baffle structure, the first lens being spaced from the first plane, the first lens being positioned on a side of the first plane which is opposite from the second plane, the light fixture comprises at least a second lens abutting the intermediate baffle structure, the second lens being positioned on a side of the second plane which is the same as the first plane, and the light fixture comprises at least a third lens abutting the inner baffle structure, the third lens being spaced from the third plane, the third lens being positioned on a side of the third plane which is the same as the first plane.

In some embodiments according to the third aspect of the present invention, the side reflector is slanted at an angle of from about 20 degrees to about 40 degrees relative to the first plane.

In some embodiments according to the third aspect of the present invention, the outer baffle structure comprises a plurality of outer baffle elements, each of the outer baffle elements having an outer baffle element first side and an outer baffle element second side which are substantially perpendicular to the first plane, the first intermediate baffle structure comprises a plurality of first intermediate baffle elements, each of the first intermediate baffle elements having a first intermediate baffle element first side and a first intermediate baffle element second side which are substantially perpendicular to the second plane, and the inner baffle structure comprises a plurality of inner baffle elements, each of the inner baffle elements having an inner baffle element first side and an inner baffle element second side which are substantially perpendicular to the third plane.

In accordance with a fourth aspect of the present invention, there is provided a light fixture comprising:

at least two recessed square elements, the two recessed square elements being concentric;

triangular connecting elements between the recessed squares; and lenses which are recessed from the faces of each of the concentric square elements.

In some embodiments according to the fourth aspect of the present invention, the light fixture comprises three of the recessed square elements.

In some embodiments according to the fourth aspect of the present invention, the light fixture comprises at least one solid state light emitter. In some of such embodiments, the at least one solid state light emitter is an LED.

The inventive subject matter may be more fully understood with reference to the accompanying drawings and the following detailed description of the inventive subject matter.

BRIEF DESCRIPTION OF THE DRAWING FIGURES

DETAILED DESCRIPTION OF THE INVENTIVE SUBJECT MATTER

Figure 1:
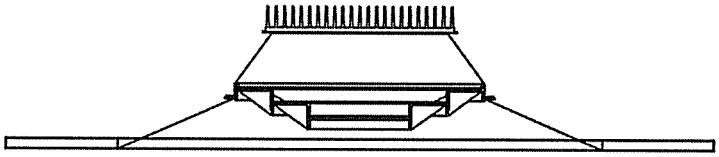
FIG. 1 is a cross-sectional view of a first embodiment of a luminaire according to the present inventive subject matter.

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Furthermore, relative terms, such as "lower" or "bottom" and "upper" or "top," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "major dimension," as used herein, means a dimension of a structure which is the largest dimension of the structure. The expression "major dimensions," as used herein, means two orthogonal dimensions (i.e,. within planes which are perpendicular) of a structure which are the largest two dimensions of the structure. In general, where a structure has two or more sides which are generally orthogonal, dimensions are measured in accordance with those orthogonal directions. For example, in the embodiment depicted in FIGS. 7 and 8, the three dimensions would be measured (1) in a direction which is parallel to the first plane of symmetry 136 and the second plane of symmetry 137, (2) in a direction which is parallel to the first plane of symmetry 136 and the first plane 80, and (3) in a direction which is parallel to the second plane of symmetry 137 and the first plane 80 Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

Embodiments in accordance with the present inventive subject matter are described herein with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

FIG. 1 is a cross-sectional view of a first embodiment of a luminaire according to the present inventive subject matter. The location of the elements of the center baffling system create optimized distribution, appearance, and brightness control.

FIGS. 2-6 depict the troffer of FIG. 1 at various angles.

Figure 2:
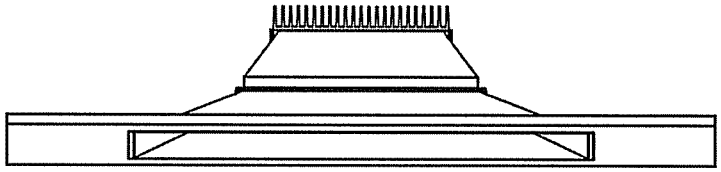
FIGS. 2-6 depict the troffer of FIG. 1 at various angles.

FIG. 2 depicts a high angle view. At this viewing angle, the occupant is typically more than 20 feet away from the light. In a large room, the majority of luminaires will have this appearance. If a luminaire is too bright at this angle, it can cause discomfort or cause veiling reflections in computers. It can also create a busy ceiling appearance. To avoid these problems, the luminous elements of the baffling system are mechanically shielded from view. The side reflectors are the only luminous elements visible at this angle. These are illuminated by the baffle system with an average luminance that is significantly less than the baffles. The luminance gradient is the greatest next to the baffle and least at the ceiling line. This allows for a comfortable visual transition from the bright baffle to the dark ceiling. This gradient is only possible with a narrow range of reflector "tilt angles" and a baffle system with the appropriate distribution.

Figure 3:
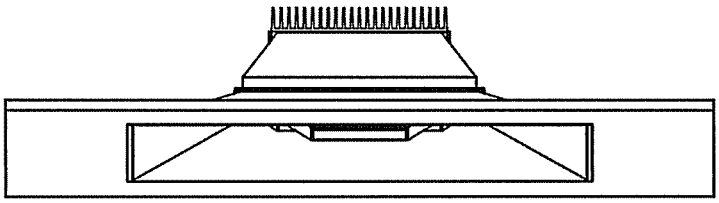

FIG. 3 is a view with the lower baffle initially revealed. As the occupant walks closer to the luminaire, the lowest part of the baffle system becomes visible. In this case, the first visible element is the lens and then the baffle. This significantly increases the maximum brightness that is visible. However, since it is the farthest from the light engine and relatively small, it is comfortable. If the first view were much broader, it would be uncomfortable.

Figure 4:
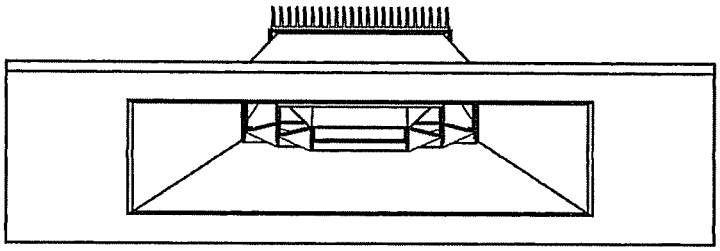

FIG. 4 is a view with more of the baffle revealed. As the occupant continues to walk towards the luminare, more of the baffle becomes visible. The apparent area of the baffle slowly increases with no significant jumps. Luminances of the reflectors and refractors are balanced, minimizing the chance for uncomfortable contrast. At no time does a new optical component become immediately visible. Any newly-appearing surface reveals itself smoothly and comfortably.

Figure 5:
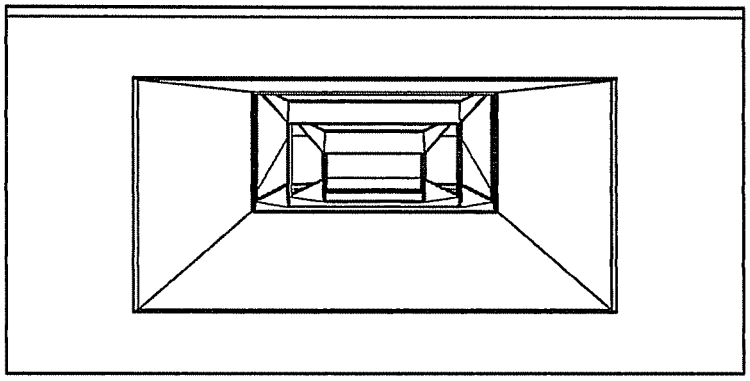

FIG. 5 is a view of most of the baffle system. As the occupant approaches the luminaire, the benefit of the non-planar baffle system becomes clear. In this view, many of the refractive elements are visible, but two of the elements on the opposite site remain hidden.

Figure 6:
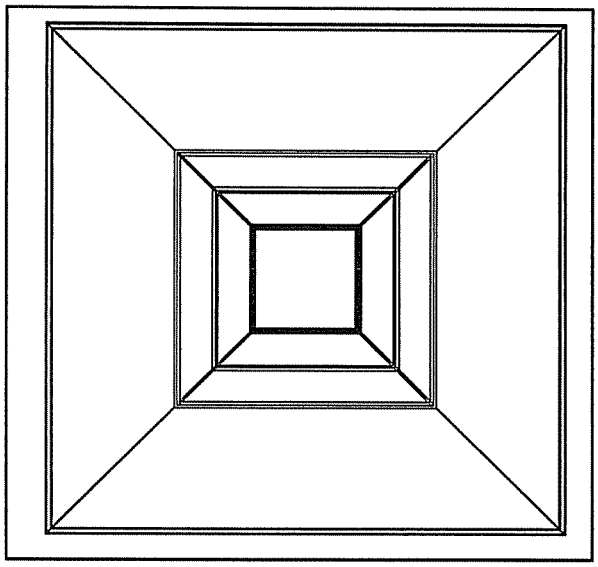

FIG. 6 is a view from directly below. All refractive elements are visible only when viewed from below. That ensures that the maximum luminances are only visible when spread across the largest possible apparent area that occurs directly beneath the fixture. This and the balanced luminance ratios—smallest at edge and greatest in the middle—ensure comfort for occupants sitting directly beneath the luminaire.

As noted above, according to various aspects of the present inventive subject matter, there is provided a light fixture comprising a baffle system and a side reflector.

As noted above, some embodiments further comprise a lighting device. The lighting device, when present, can comprise any suitable device capable of emitting light. The expression "lighting device", as used herein, is not limited, except that it indicates that the device is capable of emitting light. Persons of skill in the art are familiar with a wide variety of such lighting devices, and any of such devices can be employed in the light fixtures according to the present inventive subject matter. Representative examples of classes of lighting devices include devices which comprise incandescent lights, fluorescent lights, light emitting diodes, etc.

The baffle structures (e.g., the outer baffle structure, the first intermediate baffle structure, when present, and the inner baffle structure), and the side reflector can be formed of any desired material. Persons of skill in the art are familiar with a wide variety of suitable materials, including a variety of materials which are known for use in making baffles for light fixtures. A representative example of a suitable material for use in making the baffle structures is MCPET®, marketed by Furukawa (a Japanese corporation).

Figure 7:
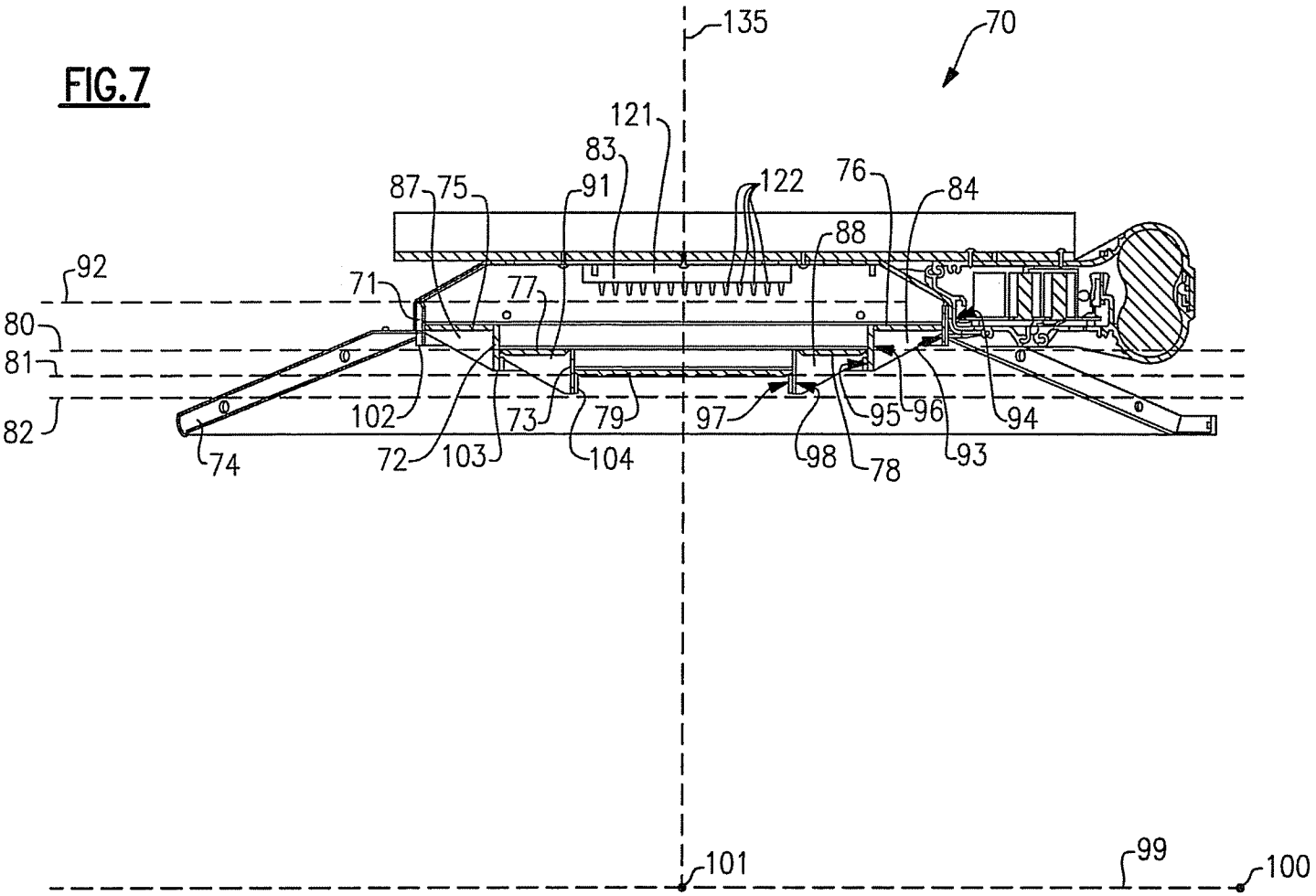
FIGS. 7 and 8 depict a second embodiment of a light fixture according to the present inventive subject matter.

As noted above, in some embodiments of the present inventive subject matter, an extremity of the outer baffle structure is in a first plane, the first plane being at a location where, if a lighting device is provided and is illuminated, light travels through the first plane. In a representative example, the extremity of the outer baffle structure is the lowermost part of the outer baffle structure if the light fixture is mounted such that light is directed downwardly. For instance, in the representative embodiment depicted in FIGS. 7 and 8 (this embodiment is referred to herein as the second embodiment), the lowermost part 102 of the outer baffle structure 71 extends completely around the periphery of the outer baffle structure 71, is an "extremity" of the outer baffle structure, and is positioned in the first plane 80. The part 102 of the outer baffle structure 71 is "lowermost" in the sense that the top of the depiction in FIG. 7 is "upper" and the bottom is "lower"—this convention will be used throughout the description herein of the drawing Figures—but the present inventive subject matter is not limited to any particular orientation of the light fixtures described herein, i.e., the light fixtures depicted in the drawing Figures could be rotated about any axis to any desired degree. Similarly, the lowermost part 103 of the first intermediate baffle structure 72 extends completely around the periphery of the first intermediate baffle structure 72, is an "extremity" of the first intermediate baffle structure, and is positioned in the second plane 81. Also, the lowermost part 104 of the inner baffle structure 73 extends completely around the periphery of the inner baffle structure 73, is an "extremity" of the inner baffle structure, and is positioned in the third plane 82.

In the embodiment depicted in FIG. 7, four surfaces of the side reflector 74 abut four respective surfaces of the outer baffle structure 71.

Figure 8:
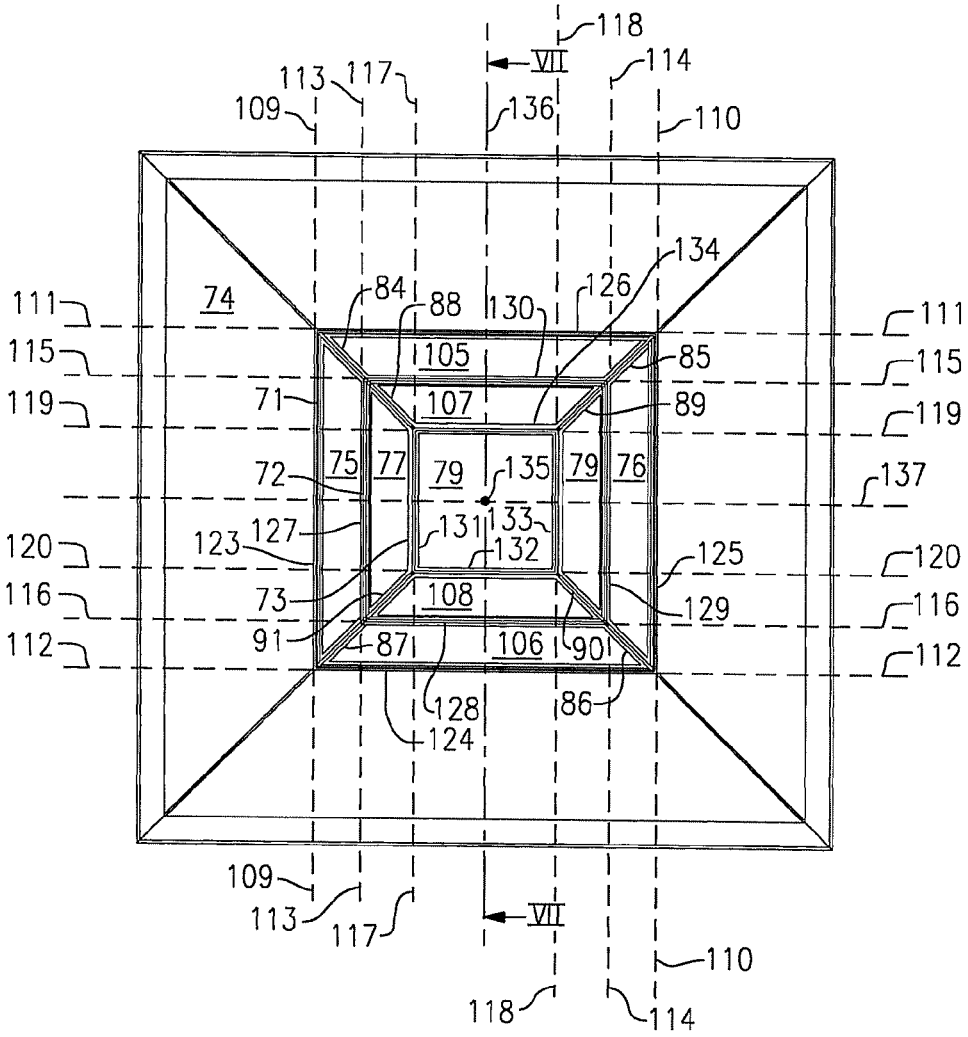

Referring to FIG. 8, it can be seen that the inner baffle structure 73 is entirely within planes 109, 110, 111, 112 which extend through the outer periphery of the outer baffle structure 71 perpendicular to the first plane 80 (i.e., the planes 109-112 extend perpendicularly into and out of the plane of the drawing page).

Referring again to FIG. 7, the second embodiment includes a lighting device 83. The lighting device 83 comprises a circuit board 121, a plurality of solid state light emitters 122 (in this embodiment, the solid state light emitters are LEDs) and circuitry for delivering desired current to each of the LEDs 122. Light emitted from the lighting device 83 travels in all directions, but in bulk, the emitted light travels downward, i.e., through the fourth plane 92, then through the first plane 80, then through the second plane 81, then through the third plane 82 and then through the plane 99 (referred to later as the "viewer plane").

Referring to FIG. 8, it can be seen that all of the LEDs 122 are located entirely within planes 117, 118, 119, 120 which extend through the outer periphery of the inner baffle structure 73 perpendicular to the first plane 80 (i.e., the planes 117-120 extend perpendicularly into and out of the plane of the drawing page).

Persons of skill in the art are familiar with a variety of solid state light emitters, and any of such solid state light emitters can be employed in the devices according to the present inventive subject matter (optionally including luminescent material(s) in any suitable form). Such solid state light emitters include inorganic and organic light emitters. Examples of types of such light emitters include a wide variety of light emitting diodes (inorganic or organic, including polymer light emitting diodes (PLEDs)), laser diodes, thin film electroluminescent devices, light emitting polymers (LEPs), a variety of each of which are well-known in the art (and therefore it is not necessary to describe in detail such devices, and/or the materials out of which such devices are made). The respective light emitters can be similar to one another, different from one another, or any combination (i.e., there can be a plurality of solid state light emitters of one type, or one or more solid state light emitters of each of two or more types).

Representative examples of suitable solid state light emitters and lumiphors are described in:

U.S. Patent Application No. 60/753,138, filed on Dec. 22, 2005, entitled "LIGHTING DEVICE" (inventor: Gerald H. Negley) and U.S. patent application Ser. No. 11/614,180, filed Dec. 21, 2006 (now U.S. Patent Publication No. 2007/0236911), the entireties of which are hereby incorporated by reference;

U.S. Patent Application No. 60/794,379, filed on Apr. 24, 2006, entitled "SHIFTING SPECTRAL CONTENT IN LEDS BY SPATIALLY SEPARATING LUMIPHOR FILMS" (inventors: Gerald H. Negley and Antony Paul van de Ven) and U.S. patent application Ser. No. 11/624,811, filed Jan. 19, 2007 (now U.S. Patent Publication No. 2007/0170447), the entireties of which are hereby incorporated by reference;

U.S. Patent Application No. 60/808,702, filed on May 26, 2006, entitled "LIGHTING DEVICE" (inventors: Gerald H. Negley and Antony Paul van de Ven) and U.S. patent application Ser. No. 11/751,982, filed May 22, 2007 (now U.S. Patent Publication No. 2007/0274080), the entireties of which are hereby incorporated by reference;

U.S. Patent Application No. 60/808,925, filed on May 26, 2006, entitled "SOLID STATE LIGHT EMITTING DEVICE AND METHOD OF MAKING SAME" (inventors: Gerald H. Negley and Neal Hunter) and U.S. patent application Ser. No. 11/753,103, filed May 24, 2007 (now U.S. Patent Publication No. 2007/0280624), the entireties of which are hereby incorporated by reference;

U.S. Patent Application No. 60/802,697, filed on May 23, 2006, entitled "LIGHTING DEVICE AND METHOD OF MAKING" (inventor: Gerald H. Negley) and U.S. patent application Ser. No. 11/751,990, filed May 22, 2007 (now U.S. Patent Publication No. 2007/0274063), the entireties of which are hereby incorporated by reference;

U.S. Patent Application No. 60/793,524, filed on Apr. 20, 2006, entitled "LIGHTING DEVICE AND LIGHTING METHOD" (inventors: Gerald H. Negley and Antony Paul van de Ven) and U.S. patent application Ser. No. 11/736,761, filed Apr. 18, 2007 (now U.S. Patent Publication No. 2007/0278934), the entireties of which are hereby incorporated by reference;

U.S. Patent Application No. 60/839,453, filed on Aug. 23, 2006, entitled "LIGHTING DEVICE AND LIGHTING METHOD" (inventors: Antony Paul van de Ven and Gerald H. Negley) and U.S. patent application Ser. No. 11/843,243, filed Aug. 22, 2007 (now U.S. Patent Publication No. 2008/0084685), the entireties of which are hereby incorporated by reference;

U.S. Patent Application No. 60/851,230, filed on Oct. 12, 2006, entitled "LIGHTING DEVICE AND METHOD OF MAKING SAME" (inventor: Gerald H. Negley) and U.S. patent application Ser. No. 11/870,679, filed Oct. 11, 2007 (now U.S. Patent Publication No. 2008/0089053), the entireties of which are hereby incorporated by reference;

U.S. Patent Application No. 60/916,608, filed on May 8, 2007, entitled "LIGHTING DEVICE AND LIGHTING METHOD" (inventors: Antony Paul van de Ven and Gerald H. Negley), the entirety of which is hereby incorporated by reference; and U.S. patent application Ser. No. 12/017,676, filed on Jan. 22, 2008 (now U.S. Patent Publication No. 2009/0108269), entitled "ILLUMINATION DEVICE HAVING ONE OR MORE LUMIPHORS, AND METHODS OF FABRICATING SAME" (inventors: Gerald H. Negley and Antony Paul van de Ven), U.S. Patent Application No. 60/982,900, filed on Oct. 26, 2007 (inventors: Gerald H. Negley and Antony Paul van de Ven), the entirety of which is hereby incorporated by reference.

Referring to FIG. 8, the outer baffle structure 71 includes four baffle elements 123, 124, 125, 126. Similarly, it can be seen that the first intermediate baffle structure 72 includes four baffle elements 127, 128, 129, 130, and the inner baffle structure 73 includes four baffle elements 131, 132, 133, 134.

The embodiment depicted in FIGS. 7 and 8 includes a plurality of lenses, namely, a first lens 75 positioned between the baffle element 123 and the baffle element_127. Similarly:

a second lens 76 is positioned between the baffle element_125 and the baffle element 129, a third lens 77 is positioned between the baffle element_127 and the baffle element 131, a fourth lens 78 is positioned between the baffle element_129 and the baffle element 133, a fifth lens 79 is positioned between the baffle element_131 and the baffle element 133, and between the baffle element 132 and the baffle element_134, a sixth lens 105 is positioned between the baffle element_126 and the baffle element 130, a seventh lens 106 is positioned between the baffle element_124 and the baffle element 128, an eighth lens 107 is positioned between the baffle element_130 and the baffle element 134, and a ninth lens 108 is positioned between the baffle element_128 and the baffle element 132.

In the light fixtures according to the present invention, lenses (when provided) may be made of any suitable material, a variety of which are known to those skilled in the art, and may be of any desired shape, a wide variety of which are known to those skilled in the art. Representative examples of materials out of which the lenses may be made include an acrylic, polycarbonate, PET, PETG or other light transmissive material. Furthermore, the lens(es) may include diffusing structures formed therein, thereon or provided by one or more films. Representative examples of such arrangements are described in U.S. Patent Application No. 61/029,068, filed on Feb. 15, 2008, entitled "LIGHT FIXTURES AND LIGHTING DEVICES" (inventors: Paul Kenneth Pickard and Gary David Trott), and U.S. Patent Application No. 61/037,366, filed on Mar. 18, 2008, the entireties of which are hereby incorporated by reference. In addition, any of the light mixing, light diffusing and/or light reflecting features discussed in U.S. Patent Application No. 61/029,068, filed on Feb. 15, 2008 and U.S. Patent Application No. 61/037,366, filed on Mar. 18, 2008 can be employed in accordance with the present inventive subject matter. In addition, any of the surfaces which light contacts can, in some embodiments, be coated with textured paint in order to alter brightness characteristics and/or patterns as desired.

As seen in FIG. 7, each of the lens is spaced from the extremity or extremities of the baffle structure or baffle structures it abuts. For instance, the fifth lens 79 is spaced from the extremity 74 of the inner baffle structure 73, i.e., it is spaced from the third plane 82. Similarly, the first lens 75 is spaced from the extremity 103 of the first intermediate baffle structure 72 and from the extremity 102 of the outer baffle structure 71, i.e., it is spaced from the first plane 80 and from the second plane 81. The fifth lens 79 is positioned on a side of the third plane 82 which is the same as the first plane 80. The first lens 75 is positioned on a side of the first plane 80 which is opposite from the second plane 81.

In the second embodiment, if the lighting device 83 is illuminated, light passes through the first plane 80 before passing through the second plane 81. In other words, light that exits the light fixture through the fifth lens 79 (i.e., which passes through the region defined by the inner baffle structure 73), has a greater vertical distance (i.e., vertical in the sense of the orientation of the light fixture depicted in FIG. 7) to mix within the light fixture than is the case with light which exits the light fixture through one of the lenses 77, 78, 107, 108 (i.e., which passes through the region located between the inner baffle structure and the first intermediate baffle structure), but the light which exits the light fixture through one of the lenses 77, 78, 107, 108 travels farther in a horizontal direction than the light which passes through the fifth lens 79. Similarly, light that exits the light fixture through one of the lenses 77, 78, 107, 108 has a greater vertical distance to mix within the light fixture than is the case with light which exits the light fixture through one of the lenses 75, 76, 105, 106 (i.e., which passes through the region located between the first intermediate baffle structure and the outer baffle structure), but the light which exits the light fixture through one of the lenses 75, 76, 105, 106 travels farther in a horizontal direction than the light which passes through one of the lenses 77, 78, 107, 108. As a result, better mixing of light can be achieved, such that variations in color and/or variations in intensity of light emitted from different areas of the light fixture can be reduced or avoided.

As noted above, in some embodiments of the present inventive subject matter, the side reflector is slanted at an angle of from about 20 degrees to about 40 degrees relative to the first plane. For example, in the embodiment depicted in FIGS. 7 and 8, the side reflector 74 defines an angle of about 22 degrees relative to the first plane 80. In other embodiments, the side reflector 74 defines an angle of about 28 degrees relative to the first plane 80. In other embodiments, the side reflector 74 defines an angle of about 34 degrees relative to the first plane 80.

As noted above, in some embodiments of the present inventive subject matter, if a lighting device is provided and is illuminated, light passes through a further plane (in the first aspect of the present inventive subject matter, the "third plane", in the third aspect of the present inventive subject matter, the "fourth plane") before passing through the first plane, the further plane being parallel to the first plane.

In the embodiment depicted in FIGS. 7 and 8, if the lighting device 83 is illuminated, light passes through the fourth plane 92 (i.e, the "further plane", above) positioned just beneath (in the orientation of the light fixture depicted in FIG. 7) the lighting device 83 before passing through the first plane 80, and the fourth plane 92 is parallel to the first plane 80.

As noted above, in some embodiments of the present inventive subject matter, the extremity of the outer baffle structure is a first series of points extending around a periphery of the outer baffle structure, wherein each of the first series of points is, for each radial position around the periphery of the outer baffle structure, a maximum distance from the "further plane."

In the embodiment depicted in FIGS. 7 and 8, the extremity 102 of the outer baffle structure 71 is a first series of points extending around a periphery of the outer baffle structure 71, wherein each of the first series of points is, for each radial position around the periphery of the outer baffle structure 71, a maximum distance from the fourth plane 92. In other words, for each radial position around the axis 135 (see FIG. 8), the location on the outer baffle structure 71 which is the farthest from the fourth plane 92 is one of the first series of points. Similarly, for each radial position around the axis 135, the location on the first intermediate baffle structure 72 which is the farthest from the fourth plane 92 is one of a second series of points, the second series of points together extending around a periphery of the first intermediate baffle structure 72 and defining the extremity 103 of the first intermediate baffle structure. For each radial position around the axis 135, the location on the inner baffle structure 73 which is the farthest from the fourth plane 92 is one of a third series of points, the third series of points together extending around a periphery of the inner baffle structure 73 and defining the extremity 104 of the inner baffle structure.

As noted above, in some embodiments of the present inventive subject matter, each series of points which defines an extremity of a baffle structure defines a substantially square shape. For example, in the embodiment depicted in FIGS. 7 and 8, the first series of points defining the extremity 102 defines a substantially square shape (see FIG. 8), the second series of points defining the extremity 103 defines a substantially square shape (see FIG. 8), and the third series of points defining the extremity 104 also defines a substantially square shape (see FIG. 8).

The expression "substantially square", as used herein, means that an annular square shape can be identified, wherein at least 90% of the points in the item which is characterized as being substantially square fall within the annular square shape, and the annular square shape includes at least 90% of the points in the item.

The expression "annular", as used herein, means a structure which extends around an unfilled region, and which can otherwise be of any general shape, and any cross-sections can be of any shape. For example, "annular" encompasses ring-like shapes which can be defined by rotating a circle about an axis in the same plane as, but spaced from, the circle. "Annular" likewise encompasses shapes which can be defined by rotating a square (or any other two-dimensional shape) about an axis in the same plane as, but spaced from, the square. "Annular" likewise encompasses shapes which can be defined by moving any shape from a first position, through space along any path without ever moving to a position where part of the shape occupies a space previously occupied by any part of the shape, and eventually returning to the first position. "Annular" likewise encompasses shapes which can be defined by moving any shape from a first position, through space along any path without ever moving to a position where part of the shape occupies a space previously occupied by any part of the shape, and eventually returning to the first position, and where the shape and size of the shape being moved can be altered at any time, and any number of times, during its movement.

In some embodiments according to the present inventive subject matter, one or more of the various baffle elements can be oriented such that their major sides are perpendicular to the first plane. For example, in the embodiment depicted in FIGS. 7 and 8, each of the baffle elements 123-134 are vertically aligned, such that the first side 93 of the baffle element 125, the second side 94 of the baffle element 133, the first side 95 of the baffle element 129, the second side 96 of the baffle element 129, the first side 97 of the baffle element 133, the second side 98 of the baffle element 133, etc., are all perpendicular to the first plane 80.

The expression "major sides," as used herein, means sides of a structure having large surface area (or largest surface area) in relation to the overall surface area of the structure.

In some embodiments according to the present inventive subject matter, the baffle system further comprises at least a first connector baffle structure extending from the outer baffle structure to the first intermediate baffle structure and a second connector baffle structure extending from the first intermediate baffle structure to the inner baffle structure. For example, in the embodiment depicted in FIGS. 7 and 8, the baffle system further comprises connector portions 84, 85, 86, 87 extending from the outer baffle structure 71 to the first intermediate baffle structure 72, and connector portions 88, 89, 90, 91 extending from the first intermediate baffle structure 72 to the inner baffle structure 73.

In some embodiments according to the present inventive subject matter, two or more of the baffle structures are substantially concentric annular shapes. For example, in the embodiment depicted in FIGS. 7 and 8, the outer baffle structure 71, the first intermediate baffle structure 72 and the inner baffle structure 73 are substantially concentric annular shapes. The expression "substantially concentric annular shapes," as used herein, means that the annular shapes have respective centers which are spaced from each other, if at all, by not more than 10 percent of a smallest distance between the annular shapes, and/or that each region of each annular shape is spaced from a region in an adjacent annular shape by a substantially uniform distance (i.e., a distance which differs by no more than 10 percent of an average of such distances).

As noted above, according to a second aspect of the present inventive subject matter, there is provided a light fixture comprising a lighting device, a baffle system, at least one side reflector; and at least one lens. In accordance with the second aspect of the present inventive subject matter, if a viewer moves from a first position to a second position, the first and second positions both being in a viewer plane which is parallel to the first plane and which is spaced from the first plane by three feet, the viewer plane being on a side of the first plane where, if the lighting device is illuminated, light travels from the lighting device toward the viewer plane, the second position being on a line which extends through a center of the light fixture perpendicular to the first plane, the first position being at least 30 feet from the second position, the viewer will see within an area bounded by the at least one side reflector:

initially only at least one of the at least one side reflector, then a portion of the baffle system which is closest to the second plane, then more of the baffle system, and then one or more of the lenses, and if the lighting system is illuminated in an absence of other light:

the side reflectors will be illuminated by the baffle system with an average luminance which is less than an average luminance of the baffle elements, and a luminance gradient will be greatest next to the baffle elements and least at regions adjacent to and outside the at least one side reflector.

For example, in the case of the embodiment depicted in FIGS. 7 and 8, if a viewer moves from a first position 100 to a second position 101, the first position 100 and the second position 101 both being in the viewer plane 99 which is parallel to the first plane 80 and which is spaced from the first plane 80 by three feet, the viewer plane 99 being on a side of the first plane 80 where, if the lighting device 83 is illuminated, light travels from the lighting device 83 toward the viewer plane 99, the second position 101 being on a line 135 which extends through a center of the light fixture 70 perpendicular to the first plane 80, the first position 100 being 30 feet from the second position 101, the viewer will see, within an area bounded by the side reflector 74:

initially only a portion of the side reflector 74, then a portion of the baffle system which is closest to the viewer plane 99, then more of the baffle system, and then one or more of the lenses, and if the lighting device 83 is illuminated in an absence of other light:

the side reflector 74 will be illuminated by the baffle system with an average luminance which is less than an average luminance of the baffle elements, and a luminance gradient will be greatest next to the baffle elements and least at regions adjacent to and outside the at least one side reflector 74.

When, in the embodiment depicted in FIGS. 7 and 8, the viewer reaches the second position 101, the viewer will be able to see at least a portion of each baffle element in the light fixture 70 and each lens in the light fixture 70, the baffle elements and the lenses in the light fixture together occupying an entire area surrounded by the side reflector 74.

Figure 9:
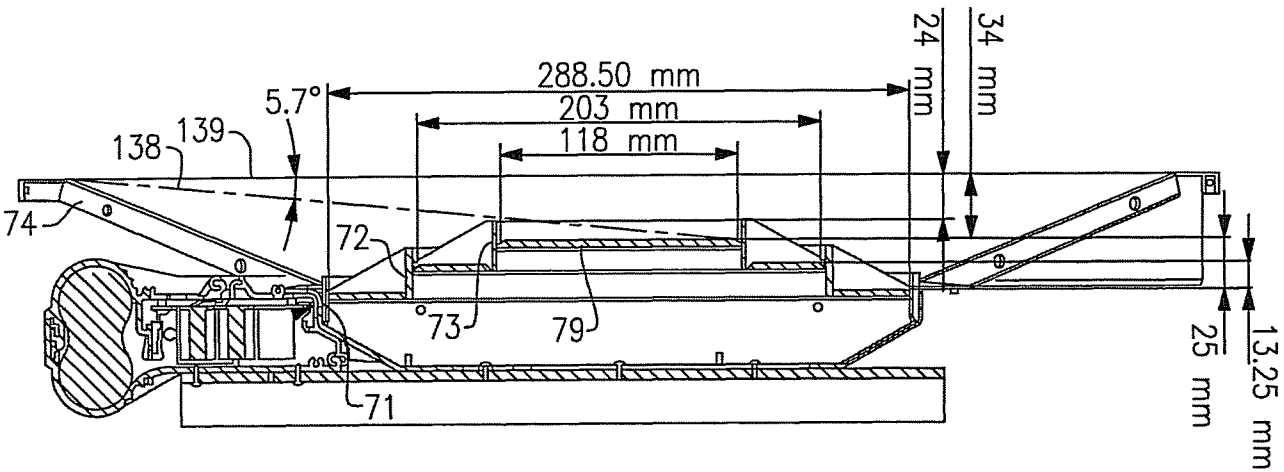
FIG. 9 depicts a third embodiment of a light fixture according to the present inventive subject matter.

FIG. 9 depicts an embodiment corresponding to the embodiment depicted in FIGS. 7 and 8, and the embodiment in FIG. 9 further specifies precise dimensions. The selection of specific dimensions of the various parts of the light fixtures according to the present invention involve trade-offs among efficacy, shielding (i.e., minimizing glare and/or providing gradual changes in intensity in the various regions and/or among the various regions as a viewer changes positions) and depth of recess. It is always desirable to obtain efficacy which is as high as possible. In some instances, more of an emphasis is placed on shielding. In some instances, more of an emphasis is placed on the depth of recess (e.g., there is only a specific amount of room available, such as the distance between a drop ceiling and a fixed ceiling from which the drop ceiling is suspended). In addition, the larger a lens area is, the more effective the diffuser needs to be in order to avoid or minimize bright spots and/or color variations. If a lens area is very small, there is generally an increased potential for glare. In some aspects, the present invention makes it possible to easily create more uniform luminances within the various lenses.

In some embodiments according to the present invention, (1) the least luminous region of the light fixture is the exposed surface of the side reflector 74, (2) the most luminous region is the fifth lens 79 (i.e., the lens inside the inner baffle structure 73), (3) the lenses 77, 78, 107 and 108 are less luminous than the fifth lens 79, (4) the lenses 75, 76, 105, 106 are less luminous than the lenses 77, 78, 107, 108, (5) the first side 97 of the inner baffle structure 73 (and the other similarly positioned sides of the inner baffle structure 73, i.e., the inner sides of the inner baffle structure 73) is less luminous than the fifth lens 79, (6) the second side 98 of the inner baffle structure 73 and the first side 95 of the first intermediate baffle structure 72 (and the other similarly positioned sides of the inner baffle structure 73 and the first intermediate baffle structure 72) are less luminous than the first side 97), and (7) the first side 93 of the outer baffle structure 71 and the second side 96 of the inner baffle structure 72 (and the other similarly positioned sides of the first intermediate baffle structure 72 and the outer baffle structure 71) are less luminous than the first side 95).

In some embodiments according to the present invention, the mechanical shield angle provided by the side reflector 74 is small enough, the fifth lens 79 is large enough, and the fifth lens 79 is recessed within the inner baffle structure 73 to a small enough extent that as a viewer approaches a position directly beneath the light fixture from a large distance (e.g., from the first position 100 to the second position 101 in FIG. 7), the viewer will see a portion of the fifth lens 79 before the viewer begins to see the second side 98 of the inner baffle structure 73 (see the line of vision 138 shown in FIG. 9). As shown in FIG. 9, the mechanical shield angle provided by the side reflector 74 from a side position (i.e., the angle between the line of vision 138 at which the fifth lens 79 first becomes unblocked by the side reflector 74) is about 5.7 degrees. In some embodiments according to the present invention, at least one mechanical shield angle provided by the side reflector 74 is in the range of from about 5 degrees to about 10 degrees, in some embodiments between about 5 degrees and about 7 degrees, and in other embodiments between about 7 degrees and about 10 degrees. The mechanical shield angle can, and in most cases will, differ at different positions around the periphery of the light fixture. As is readily apparent from FIG. 9, the mechanical shield angle is defined by (1) the distance between a plane 139 defined by the upper (upper as depicted in FIG. 9) edge of the side reflector 74 and a plane defined by the surface of the fifth lens 79 and (2) the distance in the plane 139 between the upper edge of the side reflector 74 and a projection of the opposite edge of the fifth lens 79 in the plane 139 (i.e., if the plane were moved perpendicularly to the plane 138 so as to be positioned in the plane 138, the point on the fifth lens 79 which is farthest from the upper edge of the side reflector 74).

In the embodiment depicted in FIG. 9, the order in which the viewer will be introduced to surfaces (as the viewer moves from the first position 100 to the second position 101) of the light fixture is similar to the order described in connection with FIGS. 1-6.

In the embodiment depicted in FIG. 7, the ratio of the surface area (in the plane of the page) of the entire light fixture (i.e., encompassed by the perimeter of the side reflector 74) to the surface area (also in the plane of the page) of the basket (i.e., encompassed by the perimeter of the outer baffle structure 71) is about 4:1. In some embodiments, this ratio is in the range of from about 3.6:1 to about 4.4:1. In some embodiments, this ratio is in the range of from about 2:1 to about 6:1.

In the embodiment depicted in FIG. 7, the ratio of the width of the entire light fixture (i.e., from one side of the perimeter of the side reflector 74 to an opposite side) to the width of the basket (i.e., from one side of the perimeter of the outer baffle structure 71 to an opposite side) is about 2:1. In some embodiments, this ratio is in the range of from about 1.8:1 to about 2.2:1. In some embodiments, this ratio is in the range of from about 1:5 to about 3:1. This ratio can be measured along any line, and in some embodiments, along any major dimension of the light fixture.

In the embodiment depicted in FIG. 7, the ratio of the surface area (in the plane of the page) of the basket (i.e., encompassed by the perimeter of the outer baffle structure 71) to the surface area (in the plane of the page) surrounded by the perimeter of the inner baffle structure 73 is about 5.5:1. In some embodiments, this ratio is in the range of from about 4.9:1 to about 6.1:1. In some embodiments, this ratio is in the range of from about 2.7:1 to about 8.3:1.

In the embodiment depicted in FIG. 7, the ratio of the width of the basket (i.e., from one side of the perimeter of the outer baffle structure 71 to an opposite side) to the width of the inner baffle structure 73 is about 2.3:1. In some embodiments, this ratio is in the range of from about 2.0:1 to about 2.6:1. In some embodiments, this ratio is in the range of from about 1.2:1 to about 3.5:1. This ratio can be measured along any line, and in some embodiments, along any major dimension of the light fixture.

In the embodiment depicted in FIG. 7, the ratio of the surface area (in the plane of the page) of the basket (i.e., encompassed by the perimeter of the outer baffle structure 71) to the surface area (in the plane of the page) surrounded by the perimeter of the first intermediate baffle structure 72 is about 2:1. In some embodiments, this ratio is in the range of from about 1.8:1 to about 2.2:1. In some embodiments, this ratio is in the range of from about 1:5 to about 3:1.

In the embodiment depicted in FIG. 7, the ratio of the width of the basket (i.e., from one side of the perimeter of the outer baffle structure 71 to an opposite side) to the width of the first intermediate baffle structure 72 is about 1.4:1. In some embodiments, this ratio is in the range of from about 1.3:1 to about 1.5:1. In some embodiments, this ratio is in the range of from about 1.2:1 to about 1.6:1. This ratio can be measured along any line, and in some embodiments, along any major dimension of the light fixture.

In some embodiments, (1) the depth of recess for lenses (or the lens) positioned between the inner baffle structure 73 and the first intermediate baffle structure 72, and (2) the depth of recess for lenses (or the lens) positioned between the first intermediate baffle structure 72 and the outer baffle structure 71, are substantially similar to (i.e., differ by not more than 10% from) (3) the depth of recess for the lens (or lenses) positioned within the inner baffle structure 73.

In some embodiments, (1) the ratio of the depth of recess for lenses (or the lens) positioned between the inner baffle structure 73 and the first intermediate baffle structure 72 divided by their respective widths (i.e., distance measured in a direction in a plane defined by the perimeter of the side reflector 74) (or its width), and (2) the depth of recess for lenses (or the lens) positioned between the first intermediate baffle structure 72 and the outer baffle structure 71 divided by their respective widths (or its width), are substantially similar to (i.e., differ by not more than 10% from) (3) the depth of recess for the lens (or lenses) positioned within the inner baffle structure 73 divided by its width (or their respective widths).

As noted above, according to a third aspect of the present inventive subject matter, there is provided a light fixture in which the outer baffle structure, the first intermediate baffle structure and the inner baffle structure each share at least two planes of symmetry. For example, in the embodiment depicted in FIGS. 7 and 8, the outer baffle structure 71, the first intermediate baffle structure 72 and the inner baffle structure 73 each share a first plane of symmetry 136 and a second plane of symmetry 137.

In addition, as noted above, in the third aspect of the present inventive subject matter, planes extending through portions of the outer baffle structure and being perpendicular to the first plane surround the first intermediate baffle structure, and planes extending through portions of the first intermediate baffle structure and being perpendicular to the first plane surround the inner baffle structure. For example, in the embodiment depicted in FIGS. 7 and 8, planes 109, 110, 111, 112 extending through portions of the outer baffle structure 71 and being perpendicular to the first plane 80 surround the first intermediate baffle structure 72, and planes 113, 114, 115, 116 extending through portions of the first intermediate baffle structure 72 and being perpendicular to the first plane 80 surround the inner baffle structure 73.

As noted above, according to a fourth aspect of the present inventive subject matter, there is provided a light fixture comprising:

at least two recessed square elements, the two recessed square elements being concentric;

triangular connecting elements between the recessed squares; and lenses which are recessed from the faces of each of the concentric square elements.

For example, the embodiment depicted in FIGS. 7 and 8 includes three recessed square elements (namely, the outer baffle structure 71, the first intermediate baffle structure 72 and the inner baffle structure 73), triangular connecting elements (namely, the connector portions 84-91) and lenses 75-79 and 105-108 which are recessed from the faces (namely the extremities 102, 103, 104 of the outer baffle structure 71, the first intermediate baffle structure 72 and the inner baffle structure 73, respectively).

A further aspect of the present inventive subject matter provides a luminaire in which all refractive elements are visible only when viewed from below.

Any two or more structural parts of the devices described herein can be integrated. Any structural part of the devices described herein can be provided in two or more parts (which are held together, if necessary).

Embodiments of the present inventive subject matter may be particularly well suited for use with systems for generating white light by combining a yellowish green highly unsaturated lamp (comprising a blue emitter and excess of yellow phosphor) with a red LED to produce white light, as described in:

(1) U.S. Patent Application No. 60/752,555, filed Dec. 21, 2005, entitled "LIGHTING DEVICE AND LIGHTING METHOD" (inventors: Antony Paul Van de Ven and Gerald H. Negley) and U.S. patent application Ser. No. 11/613,714, filed Dec. 20, 2006 (now U.S. Patent Publication No. 2007/0139920), the entireties of which are hereby incorporated by reference;

(2) U.S. Patent Application No. 60/793,524, filed on Apr. 20, 2006, entitled "LIGHTING DEVICE AND LIGHTING METHOD" (inventors: Gerald H. Negley and Antony Paul van de Ven) and U.S. patent application Ser. No. 11/736,761, filed Apr. 18, 2007 (now U.S. Patent Publication No. 2007/0278934), the entireties of which are hereby incorporated by reference;

(3) U.S. Patent Application No. 60/793,518, filed on Apr. 20, 2006, entitled "LIGHTING DEVICE AND LIGHTING METHOD" (inventors: Gerald H. Negley and Antony Paul van de Ven) and U.S. patent application Ser. No. 11/736,799, filed Apr. 18, 2007 (now U.S. Patent Publication No. 2007/0267983), the entireties of which are hereby incorporated by reference;

(4) U.S. Patent Application No. 60/857,305, filed on Nov. 7, 2006, entitled "LIGHTING DEVICE AND LIGHTING METHOD" (inventors: Antony Paul van de Ven and Gerald H. Negley; and U.S. patent application Ser. No. 11/936,163, filed Nov. 7, 2007 (now U.S. Patent Publication No. 2008/0106895), the entireties of which are hereby incorporated by reference;

(5) U.S. Patent Application No. 60/916,596, filed on May 8, 2007, entitled "LIGHTING DEVICE AND LIGHTING METHOD" (inventors: Antony Paul van de Ven and Gerald H. Negley), the entirety of which is hereby incorporated by reference;

(6) U.S. Patent Application No. 60/916,607, filed on May 8, 2007, entitled "LIGHTING DEVICE AND LIGHTING METHOD" (inventors: Antony Paul van de Ven and Gerald H. Negley), the entirety of which is hereby incorporated by reference;

(7) U.S. Patent Application No. 60/839,453, filed on Aug. 23, 2006, entitled "LIGHTING DEVICE AND LIGHTING METHOD" (inventors: Antony Paul van de Ven and Gerald H. Negley) and U.S. patent application Ser. No. 11/843,243, filed Aug. 22, 2007 (now U.S. Patent Publication No. 2008/0084685), the entireties of which are hereby incorporated by reference;

(8) U.S. Pat. No. 7,213,940, issued on May 8, 2007, entitled "LIGHTING DEVICE AND LIGHTING METHOD" (inventors: Antony Paul van de Ven and Gerald H. Negley), the entirety of which is hereby incorporated by reference;

(9) U.S. Patent Application No. 60/868,134, filed on Dec. 1, 2006, entitled "LIGHTING DEVICE AND LIGHTING METHOD" (inventors: Antony Paul van de Ven and Gerald H. Negley), the entirety of which is hereby incorporated by reference;

(10) U.S. patent application Ser. No. 11/948,021, filed on Nov. 30, 2007 (now U.S. Patent Publication No. 2008/0130285), entitled "LIGHTING DEVICE AND LIGHTING METHOD" (inventors: Antony Paul van de Ven and Gerald H. Negley), the entirety of which is hereby incorporated by reference;

(11) U.S. Patent Application No. 60/868,986, filed on Dec. 7, 2006, entitled "LIGHTING DEVICE AND LIGHTING METHOD" (inventors: Antony Paul van de Ven and Gerald H. Negley), and U.S. patent application Ser. No. 11/951,626, filed Dec. 6, 2007 (now U.S. Patent Publication No. 2008/0136313), the entireties of which are hereby incorporated by reference;

(12) U.S. Patent Application No. 60/916,597, filed on May 8, 2007, entitled "LIGHTING DEVICE AND LIGHTING METHOD" (inventors: Antony Paul van de Ven and Gerald H. Negley) and U.S. Patent Application No. 60/944,848, filed Jun. 19, 2007, the entireties of which are hereby incorporated by reference; and

(13) U.S. Patent Application No. 60/990,435, filed on Nov. 27, 2007, entitled "WARM WHITE ILLUMINATION WITH HIGH CRI AND HIGH EFFICACY" (inventors: Antony Paul van de Ven and Gerald H. Negley), the entirety of which is hereby incorporated by reference.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

The invention claimed is:

1. A light fixture comprising a baffle system and a side reflector, said baffle system comprising at least an outer baffle structure and an inner baffle structure, said side reflector comprising a first end portion and a second end portion, said second end portion spaced from said first end portion relative to an axis of said outer baffle structure, an extremity of said outer baffle structure in a first plane, an extremity of said inner baffle structure in a second plane, said second plane substantially parallel to said first plane, said second plane spaced from said first plane in a first direction along said axis of said outer baffle structure, said first end portion of said side reflector abutting at least one outer surface of said outer baffle structure, said at least one outer surface of said outer baffle structure facing outward from said light fixture in a direction substantially perpendicular to said axis of said outer baffle structure, said side reflector extending through said first plane and through said second plane to said second end portion of said side reflector, at least a portion of said second end portion below said first end portion if said light fixture is oriented so that said first direction is vertically downward, said first end portion entirely within a space defined by lines that (1) extend through said second end portion and (2) are parallel to said axis of said outer baffle structure, said inner baffle structure entirely within planes which extend through an outer periphery of said outer baffle structure perpendicular to said first plane.

2. A light fixture as recited in claim 1, wherein:

said light fixture further comprises at least one lighting device, said first plane is at a location where, if said lighting device is illuminated, light travels through said first plane, and said second plane is at a location where, if said lighting device is illuminated, light travels through said second plane.

3. A light fixture as recited in claim 2, wherein said lighting device comprises at least one solid state light emitter, each of said at least one solid state light emitter entirely within a region defined by planes which extend through said extremity of said inner baffle structure perpendicular to said first plane.

4. A light fixture as recited in claim 3, wherein if said lighting device is illuminated, light passes through said first plane before passing through said second plane.

5. A light fixture as recited in claim 2, wherein:

if said lighting device is illuminated, light passes through a third plane before passing through said first plane, said third plane parallel to said first plane, said extremity of said outer baffle structure is a first series of points extending around a periphery of said outer baffle structure, wherein each of said first series of points is, for each radial position around said periphery of said outer baffle structure, a maximum distance from said third plane, and said extremity of said inner baffle structure is a second series of points extending around a periphery of said inner baffle structure, wherein each of said second series of points is, for each radial position around said periphery of said inner baffle structure, a maximum distance from said third plane.

6. A light fixture as recited in claim 5, wherein said first series of points defines a first substantially square shape, and said second series of points defines a second substantially square shape.

7. A light fixture as recited in claim 1, wherein said baffle system comprises a plurality of baffle elements and said light fixture further comprises at least a first lens, said first lens between a first surface of one baffle element and a second surface of another baffle element, said first surface substantially perpendicular to said first plane and said second plane, said second surface substantially perpendicular to said first plane and said second plane.

8. A light fixture as recited in claim 7, wherein said light fixture comprises at least a first lens abutting said outer baffle structure, said first lens spaced from said first plane, said first lens on a side of said first plane which is opposite from said second plane, and said light fixture comprises at least a second lens abutting said inner baffle structure, said second lens on a side of said second plane which is the same as said first plane.

9. A light fixture as recited in claim 1, wherein said side reflector is slanted at an angle of from about 20 degrees to about 40 degrees relative to said first plane.

10. A light fixture as recited in claim 1, wherein:

said outer baffle structure comprises a plurality of outer baffle elements, each of said outer baffle elements having an outer baffle element first side and an outer baffle element second side which are substantially perpendicular to said first plane, and said inner baffle structure comprises a plurality of inner baffle elements, each of said inner baffle elements having an inner baffle element first side and an inner baffle element second side which are substantially perpendicular to said second plane.

11. A light fixture as recited in claim 1, wherein at least a portion of said side reflector is in a third plane, and said second plane is between said first plane and said third plane.

12. A light fixture as recited in claim 1, wherein:

said light fixture further comprises at least a first lighting device;

said first plane is defined by a series of points extending around a periphery of said outer baffle structure;

said second plane is defined by a series of points extending around a periphery of said inner baffle structure;

if said first lighting device is illuminated, light emitted from said first lighting device passes through a fourth plane before passing through said first plane or said second plane, said fourth plane parallel to said first plane and said second plane;

said series of points extending around a periphery of said outer baffle structure is, for each radial position around said periphery of said outer baffle structure, a maximum distance on said outer baffle structure from said fourth plane; and said series of points extending around a periphery of said inner baffle structure is, for each radial position around said periphery of said inner baffle structure, a maximum distance on said inner baffle structure from said fourth plane.

13. A light fixture as recited in claim 12, wherein if said first lighting device is illuminated, light emitted from said first lighting device passes through said first plane before it passes through said second plane.

14. A light fixture as recited in claim 12, wherein if said first lighting device is illuminated, light emitted from said first lighting device passes through said second plane before it passes through said first plane.

15. A light fixture as recited in claim 1, wherein:

said light fixture further comprises at least one lighting device, said extremity of said outer baffle structure in said first plane is an extremity with respect to said lighting device, at least a portion of said side reflector is in a third plane, said third plane farther from said lighting device than said first plane, and if said lighting device is illuminated, light passes through said first plane before passing through said second plane, and through said second plane before passing through said third plane.

16. A light fixture as recited in claim 1, wherein said outer baffle structure and said inner baffle structure are configured to baffle light emitting from said light fixture.

17. A light fixture comprising:

a lighting device;

a baffle system, said baffle system comprising a plurality of baffle elements, at least one side reflector; and at least one lens, each of said at least one lens between respective baffle elements, first and second major dimensions of said light fixture extending in a first plane, at least one surface of said side reflector abutting at least one surface of said baffle system, wherein if a viewer moves from a first position to a second position, said first and second positions both in a viewer plane which is parallel to said first plane and which is spaced from said first plane by three feet, said viewer plane on a side of said first plane where, if said lighting device is illuminated, light travels from said lighting device toward said viewer plane, said second position on a line which extends through a center of said light fixture perpendicular to said first plane, said first position at least 30 feet from said second position, said viewer will see within an area bounded by said at least one side reflector:

initially only at least one of said at least one side reflector, then a portion of the baffle system which is closest to said viewer plane, then more of said baffle system, and then one or more of said lenses, and if said lighting device is illuminated in an absence of other light:

said side reflector will be illuminated with an average luminance which is less than an average luminance of said baffle elements, and a luminance gradient in the side reflector will be greatest in regions of the side reflector that are adjacent to said baffle elements and least at regions of the side reflector that are adjacent to an outer periphery of the side reflector.

18. A light fixture as recited in claim 17, wherein when said viewer reaches said second position, said viewer will be able to see at least a portion of each baffle element in said light fixture and each lens in said light fixture, said baffle elements in said light fixture and said at least one lens in said light fixture together occupying an entire area surrounded by said side reflector.

19. A light fixture as recited in claim 17, wherein:

said baffle system comprises an inner baffle structure, and said lighting device comprises at least one solid state light emitter, each of said at least one solid state light emitter entirely within a region defined by planes which extend through an extremity of said inner baffle structure perpendicular to said first plane.

20. A light fixture as recited in claim 17, wherein said side reflector is slanted at an angle of from about 20 degrees to about 40 degrees relative to said first plane.

21. A light fixture comprising a baffle system and a side reflector, said baffle system comprising at least an outer baffle structure, an inner baffle structure and at least a first intermediate baffle structure, said side reflector comprising a first end portion and a second end portion, said second end portion spaced from said first end portion relative to an axis of said outer baffle structure, said outer baffle structure annular, an extremity of said outer baffle structure in a first plane, said first intermediate baffle structure annular, an extremity of said first intermediate baffle structure in a second plane, said second plane substantially parallel with said first plane, said inner baffle structure annular, an extremity of said inner baffle structure in a third plane, said third plane substantially parallel with said second plane, said second plane between said first plane and said third plane, said third plane spaced from said first plane in a first direction along said axis of said outer baffle structure, said outer baffle structure, said first intermediate baffle structure and said inner baffle structure each sharing at least two planes of symmetry, planes extending through portions of said outer baffle structure and perpendicular to said first plane surrounding said first intermediate baffle structure, planes extending through portions of said first intermediate baffle structure and perpendicular to said first plane surrounding said inner baffle structure, said first end portion of said side reflector abutting at least one outer surface of said outer baffle structure, said at least one outer surface of said outer baffle structure facing outward from said light fixture in a direction substantially perpendicular to said axis of said outer baffle structure, said side reflector extending through said first plane, through said second plane, and through said third plane to said second end portion of said side reflector, at least a portion of said second end portion below said first end portion if said light fixture is oriented so that said first direction is vertically downward, said first end portion entirely within a space defined by lines that (1) extend through said second end portion and (2) are parallel to said axis of said outer baffle structure.

22. A light fixture as recited in claim 21, wherein:

said light fixture further comprises at least one lighting device, said first plane is at a location where, if said lighting device is illuminated, light travels through said first plane, said second plane is at a location where, if said lighting device is illuminated, light travels through said second plane and said third plane at a location where, if said lighting device is illuminated, light travels through said third plane.

23. A light fixture as recited in claim 22, wherein if said lighting device is illuminated, light travels through said first plane, then through said second plane, and then through said third plane.

24. A light fixture as recited in claim 22, wherein said lighting device comprises at least one solid state light emitter, each of said at least one solid state light emitter entirely within a region defined by planes which extend through said extremity of said inner baffle structure perpendicular to said first plane.

25. A light fixture as recited in claim 22, wherein:

if said lighting device is illuminated, light passes through a fourth plane before passing through said first plane, said fourth plane parallel to said first plane, said extremity of said outer baffle structure is a first series of points extending around a periphery of said outer baffle structure, wherein each of said first series of points is, for each radial position around said periphery of said outer baffle structure, a maximum distance from said fourth plane, said extremity of said first intermediate baffle structure is a second series of points extending around a periphery of said first intermediate baffle structure, wherein each of said second series of points is, for each radial position around said periphery of said first intermediate baffle structure, a maximum distance from said fourth plane, and said extremity of said inner baffle structure is a third series of points extending around a periphery of said inner baffle structure, wherein each of said third series of points is, for each radial position around said periphery of said inner baffle structure, a maximum distance from said fourth plane.

26. A light fixture as recited in claim 25, wherein said first series of points defines a first substantially square shape, and said second series of points defines a second substantially square shape.

27. A light fixture as recited in claim 21, wherein said baffle system further comprises at least a first connector baffle structure extending from said outer baffle structure to said first intermediate baffle structure and a second connector baffle structure extending from said first intermediate baffle structure to said inner baffle structure.

28. A light fixture as recited in claim 21, wherein said outer baffle structure, said first intermediate baffle structure and said inner baffle structure are substantially concentric annular shapes.

29. A light fixture as recited in claim 28, wherein each of said outer baffle structure, said first intermediate baffle structure and said inner baffle structure has a substantially square annular shape.

30. A light fixture as recited in claim 21, wherein said baffle system comprises a plurality of baffle elements, and said light fixture further comprises at least a first lens, said first lens between a first surface of one baffle element and a second surface of another baffle element, said first surface substantially perpendicular to said first plane and said second plane, said second surface substantially perpendicular to said first plane and second plane.

31. A light fixture as recited in claim 30, wherein said light fixture comprises at least a first lens abutting said outer baffle structure, said first lens spaced from said first plane, said first lens on a side of said first plane which is opposite from said second plane, said light fixture comprises at least a second lens abutting said intermediate baffle structure, said second lens on a side of said second plane which is the same as said first plane, and said light fixture comprises at least a third lens abutting said inner baffle structure, said third lens spaced from said third plane, said third lens on a side of said third plane which is the same as said first plane.

32. A light fixture as recited in claim 21, wherein said side reflector is slanted at an angle of from about 20 degrees to about 40 degrees relative to said first plane.

33. A light fixture as recited in claim 21, wherein:

said outer baffle structure comprises a plurality of outer baffle elements, each of said outer baffle elements having an outer baffle element first side and an outer baffle element second side which are substantially perpendicular to said first plane, said first intermediate baffle structure comprises a plurality of first intermediate baffle elements, each of said first intermediate baffle elements having a first intermediate baffle element first side and a first intermediate baffle element second side which are substantially perpendicular to said second plane, and said inner baffle structure comprises a plurality of inner baffle elements, each of said inner baffle elements having an inner baffle element first side and an inner baffle element second side which are substantially perpendicular to said third plane.

34. A light fixture as recited in claim 21, wherein said outer baffle structure and said inner baffle structure are configured to baffle light emitting from said light fixture.

35. A light fixture as recited in claim 21, wherein at least a portion of said side reflector is in a fourth plane, and said second plane is between said first plane and said fourth plane.

36. A light fixture as recited in claim 21, wherein if said first lighting device is illuminated, light emitted from said first lighting device passes through said second plane before it passes through said first plane.

37. A light fixture as recited in claim 21, wherein:

said light fixture further comprises at least one lighting device, said extremity of said outer baffle structure in said first plane is an extremity with respect to said lighting device, and at least a portion of said side reflector is in a fourth plane, said fourth plane farther from said lighting device than said first plane, and if said lighting device is illuminated, light passes through said first plane before passing through said second plane, through said second plane before passing through said third plane, and through said third plane before passing through said fourth plane.

38. A light fixture comprising:

at least a first element and a second element, at least a first connecting element, and at least a first lens, said first element substantially annular, said second element substantially annular, said first element and said second element concentric;, an extremity of said first element in a first plane, said first plane perpendicular to an axis of said first element, an extremity of said second element in a second plane, said second plane perpendicular to said axis of said first element, said second plane spaced from said first plane, said first connecting element extending between said first element and said second element, and said first lens extending from said first element to said second element, said first lens spaced from said first plane.

39. A light fixture as recited in claim 38, wherein said light fixture comprises three elements, comprising said first element, said second element and a third element, and each of the first, second, and third elements is substantially square annular.

40. A light fixture as recited in claim 38, wherein said light fixture comprises at least one solid state light emitter.

41. A light fixture as recited in claim 40, wherein said at least one solid state light emitter is an LED.

42. A light fixture as recited in claim 38, wherein:

said light fixture further comprises a lighting device, said light fixture further comprises at least one side reflector that abuts one of said first element and said second element, first and second major dimensions of said light fixture extend in a first plane, and if a viewer moves from a first position to a second position, said first and second positions both in a viewer plane which is parallel to said first plane and which is spaced from said first plane by three feet, said viewer plane on a side of said first plane where, if said lighting device is illuminated, light travels from said lighting device toward said viewer plane, said second position on a line which extends through a center of said light fixture perpendicular to said first plane, said first position at least 30 feet from said second position, said viewer will see within an area bounded by said at least one side reflector:

initially only at least one of said at least one side reflector, then a portion of at least one of the first element and the second element which is closest to said viewer plane, then more of said at least one of said at least one side reflector, and then one or more of said lenses.

43. A light fixture as recited in claim 42, wherein if said lighting device is illuminated in an absence of other light:

said at least one side reflector will be illuminated with an average luminance which is less than an average luminance of said first and second elements, and a luminance gradient in at least a first of said at least one side reflector will be greatest in regions of the first side reflector that are adjacent to said first and second elements and least at regions of the first side reflector that are adjacent to an outer periphery of the first side reflector.

44. A light fixture as recited in claim 38, wherein said light fixture further comprises a side reflector, said first element and said second element recessed relative to said side reflector.

45. A light fixture as recited in claim 44, wherein at least one of said first and second elements abuts said side reflector.

46. A light fixture as recited in claim 45, wherein:

said at least a first element comprises at least a first square element; and said at least a second element comprises at least a second square element;

said light fixture further comprises at least one side reflector;

said light fixture further comprises at least a first lighting device;

a first plane is a plane that is a maximum distance from said first lighting device of any plane on which there are at least three points on said first square element that are spaced from each other by at least half of a maximum dimension of said first square element;

a second plane is a plane that is a maximum distance from said first lighting device of any plane on which there are at least three points on said second square element that are spaced from each other by at least half of a maximum dimension of said second square element;

a third plane is a plane that is a maximum distance from said first lighting device of any plane on which there are at least three points on said side reflector that are spaced from each other by at least half of a maximum dimension of said side reflector; and said third plane is farther from said first lighting device than said first plane and said second plane.

47. A light fixture as recited in claim 38, wherein:

said first element comprises at least a first square element; and said second element comprises at least a second square element;

said light fixture further comprises at least a first lighting device;

a first plane is a plane that is a maximum distance from said first lighting device of any plane on which there are at least three points on said first square element that are spaced from each other by at least half of a maximum dimension of said first square element;

a second plane is a plane that is a maximum distance from said first lighting device of any plane on which there are at least three points on said second square element that are spaced from each other by at least half of a maximum dimension of said second square element; and said second plane is farther from said first lighting device than said first plane.

48. A light fixture as recited in claim 38, wherein:

said first element comprises at least a first recessed square element; and said second element comprises at least a second recessed square element, an extremity of said second recessed square element in a first plane, said first recessed square element entirely within planes which extend through an outer periphery of said second recessed square element perpendicular to said first plane.

49. A light fixture as recited in claim 38, wherein said light fixture comprises at least two connecting elements that each connect said first and second elements.

50. A light fixture as recited in claim 38, wherein at least one of said first and second elements is recessed relative to at least one other of said first and second elements.

51. A light fixture as recited in claim 38, wherein a recessed portion of at least one of said first and second elements baffles light in a direction away from said light fixture.

52. A light fixture comprising:

a lighting device;

a baffle system, said baffle system comprising a plurality of baffle elements, at least one side reflector; and at least one lens, each of said at least one lens between respective baffle elements, first and second major dimensions of said light fixture extending in a first plane, at least one surface of said side reflector abutting at least one surface of said baffle system, wherein if a viewer moves from a first position to a second position, said first and second positions both in a viewer plane which is parallel to said first plane and which is spaced from said first plane by three feet, said viewer plane on a side of said first plane where, if said lighting device is illuminated, light travels from said lighting device toward said viewer plane, said second position on a line which extends through a center of said light fixture perpendicular to said first plane, said first position at least 30 feet from said second position, said viewer will see within an area bounded by said at least one side reflector:

initially only at least one of said at least one side reflector, then a portion of the baffle system which is closest to said viewer plane, then more of said baffle system, and then one or more of said lenses, and if said lighting device is illuminated in an absence of other light:

said side reflector will be illuminated by said baffle system with an average luminance which is less than an average luminance of said baffle elements, and a luminance gradient will be greatest next to said baffle elements and least at regions adjacent to and outside said at least one side reflector.

53. A light fixture comprising:

at least a first element and a second element, at least a first connecting element, and at least a first lens, said first element substantially annular, said second element substantially annular, said first element and said second element concentric;, an extremity of said first element in a first plane, said first plane perpendicular to an axis of said first element, an extremity of said second element in a second plane, said second plane perpendicular to said axis of said first element, said second plane spaced from said first plane, said first connecting element extending between said first element and said second element, and said first lens in a direct path from said first element to said second element, said first lens spaced from said first plane.

* * * * *

UNITED STATES PATENT AND TRADEMARK OFFICE

CERTIFICATE OF CORRECTION

PATENT NO. : 9,310,035 B2
APPLICATION NO. : 12/116341
DATED : April 12, 2016
INVENTOR(S) : Gary David Trott et al.

It is certified that error appears in the above-identified patent and that said Letters Patent is hereby corrected as shown below:

IN THE SPECIFICATION

Col. 11, Lines 36 - 55

Please change: "The embodiment depicted in FIGS. 7 and 8 includes a plurality of lenses, namely, a first lens 75 positioned between the baffle element 123 and the baffle element_127. Similarly:

a second lens 76 is positioned between the baffle element_125 and the baffle element 129, a third lens 77 is positioned between the baffle element_127 and the baffle element 131, a fourth lens 78 is positioned between the baffle element_129 and the baffle element 133, a fifth lens 79 is positioned between the baffle element_131 and the baffle element 133, and between the baffle element 132 and the baffle element_134, a sixth lens 105 is positioned between the baffle element_126 and the baffle element 130, a seventh lens 106 is positioned between the baffle element_124 and the baffle element 128, an eighth lens 107 is positioned between the baffle element_130 and the baffle element 134, and a ninth lens 108 is positioned between the baffle element_128 and the baffle element 132."

to --The embodiment depicted in FIGS. 7 and 8 includes a plurality of lenses, namely, a first lens 75 positioned between the baffle element 123 and the baffle element 127.

Similarly:

a second lens 76 is positioned between the baffle element 125 and the baffle element 129, a third lens 77 is positioned between the baffle element 127 and the baffle element 131, a fourth lens 78 is positioned between the baffle element 129 and the baffle element 133, Signed and Sealed this
Twenty-first Day of June, 2016

Michelle K. Lee

Michelle K. Lee
*Director of the United States Patent and Trademark Office* a fifth lens 79 is positioned between the baffle element 131 and the baffle element 133, and between the baffle element 132 and the baffle element 134, a sixth lens 105 is positioned between the baffle element 126 and the baffle element 130, a seventh lens 106 is positioned between the baffle element 124 and the baffle element 128, an eighth lens 107 is positioned between the baffle element 130 and the baffle element 134, and a ninth lens 108 is positioned between the baffle element 128 and the baffle element 132.--